United States Patent [19]

Rader et al.

[11] Patent Number: 4,936,588

[45] Date of Patent: Jun. 26, 1990

[54] BOARD GAME COMBINING CHANCE AND SKILL

[76] Inventors: Robert E. Rader; Mary A. Rader, both of 330 Knoll Woods Ter., Roswell, Ga. 30075

[21] Appl. No.: 292,903

[22] Filed: Jan. 3, 1989

[51] Int. Cl.[5] ..... A63F 3/00

[52] U.S. Cl. ..... 273/243; 273/268

[58] Field of Search ..... 273/243, 268, 274, 146, 273/138 R, 242

[56] References Cited

U.S. PATENT DOCUMENTS

| | | | |
|---|---|---|---|
| 3,033,572 | 5/1962 | Thibault | 273/243 |
| 3,850,434 | 11/1974 | Ockenfels | 273/274 |
| 3,913,919 | 10/1975 | Carpenter | 273/274 |
| 3,929,337 | 12/1975 | Hayes . | |
| 4,042,245 | 8/1977 | Zarour . | |
| 4,087,093 | 5/1978 | Imbert | 273/243 |
| 4,129,304 | 12/1978 | Mager | 273/243 |
| 4,184,686 | 1/1980 | Merced . | |
| 4,234,186 | 11/1980 | Forrest et al. | 273/243 |
| 4,334,685 | 6/1982 | Robbins . | |
| 4,746,126 | 5/1988 | Angileri | 273/274 X |

*Primary Examiner*—Edward M. Coven
*Assistant Examiner*—William E. Stoll
*Attorney, Agent, or Firm*—James A. Hinkle

[57] ABSTRACT

The game board apparatus comprising a game board including a plurality of locations arranged around the perimeter of the game board to form a game movement area for the movement of player's tokens. The plurality of locations on the game board include printed indicia, which require players to take certain actions upon landing on the discrete locations upon the roll of dice. The roll of the dice determines each player's move around the periphery of the game board and determines the score according to predetermined combinations of the value on the dice.

13 Claims, 2 Drawing Sheets

SHARPSHOOTER SCORE SHEET

= 100 POINTS = 50 POINTS

= STRAIGHT = 1500 POINTS

= ANY 3 PAIR = 1000 POINTS

= 1000 POINTS = 2000 POINTS

= 3000 POINTS

= 3 OF A KIND = 100 TIMES THE NUMBER ON THE DIE

= 4 OF A KIND = 200 TIMES THE NUMBER ON THE DIE

= 5 OF A KIND = 300 TIMES THE NUMBER ON THE DIE

= 6 OF A KIND = 400 TIMES THE NUMBER ON THE DIE

= 6 NATURAL = AUTOMATIC WIN.

— PLAYERS —

| | | | | | | | |
|---|---|---|---|---|---|---|---|
| | | | | | | | |

BOARD GAME COMBINING CHANCE AND SKILL

BACKGROUND OF THE INVENTION

I. Field of the Invention

The present invention relates generally to a board game and more particularly to a board game which combines a fast moving game of skill and chance that may be enjoyed by two or more players utilizing a plurality of dice and playing tokens which are moved around a board by each player and whose moves are dictated by the roll of the dice.

II. Description of the Prior Art

The prior art is replete with board games involving skill and/or chance and are a well known form of amusement. Frequently, however, board games in the prior art tend to be slow moving and do not present a particular challenge to the players or to maintain a high degree of interest for an extended period of time.

BRIEF SUMMARY OF THE INVENTION

It is therefore an object of the present invention, to provide an improved board game.

It is another object of the present invention to provide a board game which combines both chance and skill for a plurality of players.

It is yet another object of the present invention to provide a board game which involves, not only strategy in moving a players playing token, but involves certain strategy and chance, and intellectual thought by each player.

Other objects, advantages and capabilities of the invention will become apparent from the following description, taken in conjunction with the accompanying drawings, showing only a preferred embodiment of the invention.

DESCRIPTION OF THE PREFERRED EMBODIMENT

Figure 1:
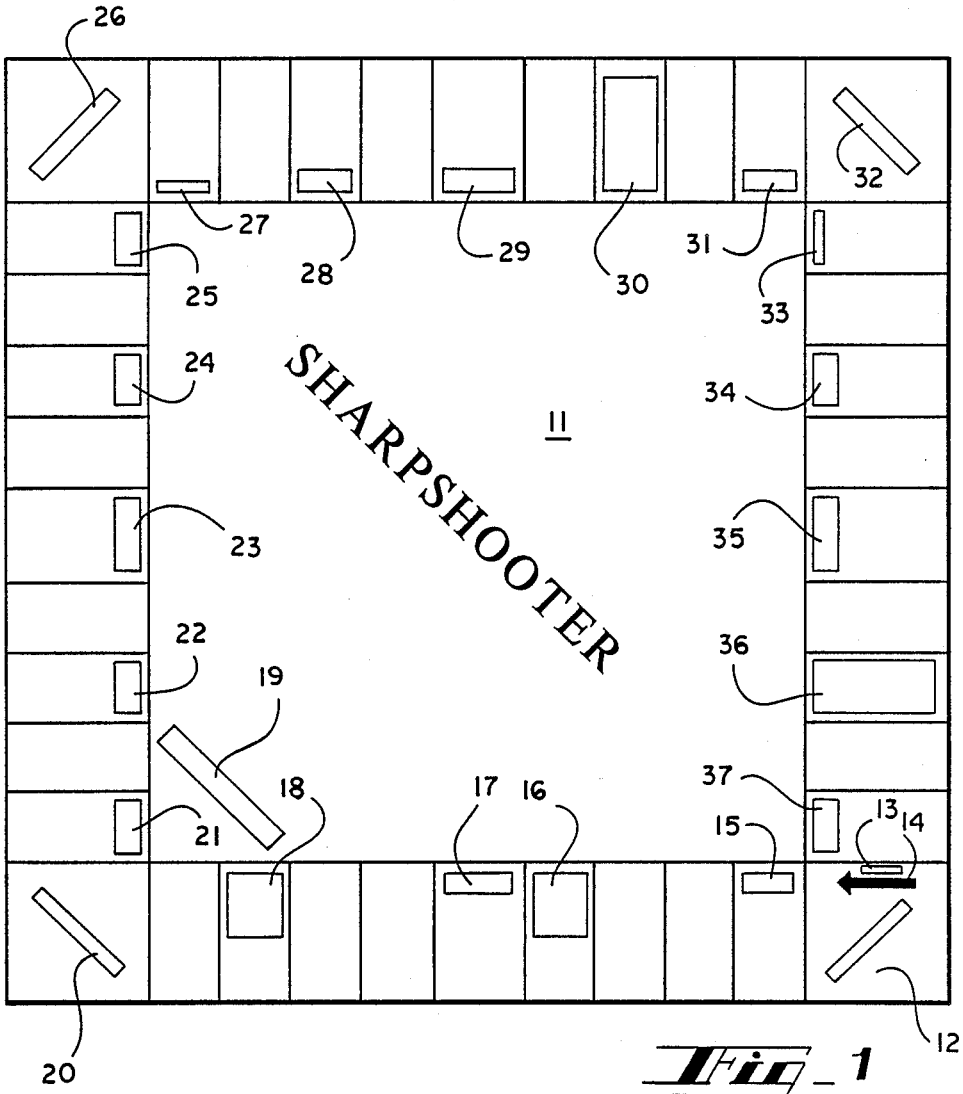
FIG. 1 is a top plan view of a game board according to the present invention.

Referring to the drawings wherein like reference numerals designate corresponding parts throughout the several figures, the game board of the present invention is designated by the numeral 11. The board 11 has forty spaces on which a player may land. Twenty-three of the spaces have special playing instructions which will affect the player's turn. The board layout, as shown in FIG. 1, does not show the particular special playing instructions on the twenty-three spaces inasmuch as there is not room in the drawing to make the detailed indicia up on the board. However, there follows a complete listing of the special instructions which apply to the individual spaces:

| Numeral On Drawings | Indicia for the Twenty-three (23) Discrete Spaces |
|---|---|
| 13 | Start |
| 14 | 2's are wild |
| 15 | Double score |
| 16 | 1,000 point bonus with turn |
| 17 | Take two turns |
| 18 | 500 point bonus with turn |
| 19 | All blank spaces are regular turn |
| 20 | 4's are wild |
| 21 | Double score |
| 22 | Go back 2 spaces |
| 23 | Lose a turn |
| 24 | ½ Score |
| 25 | Take 2 turns |
| 26 | 6's are wild |
| 27 | ½ Score |
| 28 | Go back 2 spaces |
| 29 | Take 2 turns |
| 30 | Wager 500 points that you score 300 points with one roll of the dice (odds 2–1) |
| 31 | Triple score |
| 32 | 3's are wild |
| 33 | ½ Score |
| 34 | Advance 2 spaces |
| 35 | Lose a turn |
| 36 | Wager 500 points that you score 300 points with one roll of the dice (odds 2–1) |
| 37 | Triple score |

Figure 2:
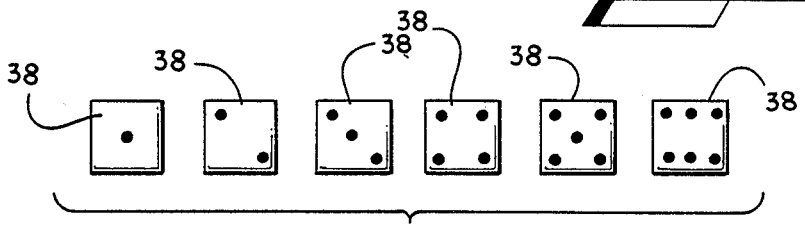
FIG. 2 is a top plan view of the dice utilized in the play of the board game of the present invention.
Figures 3, 4:
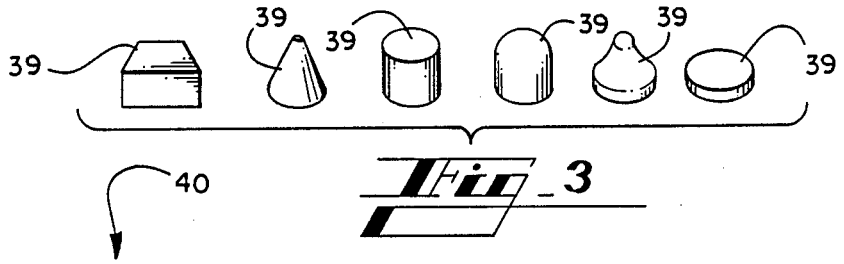
FIG. 3 is a perspective view of the playing tokens.
FIG. 4 shows a top plan view of the score sheet utilized by the players when playing the present board game.

The preferred embodiment of the invention utilizes six (6) dice, all of which are collectively indicated by the numeral 38 in FIG. 2. The players will choose a suitable playing token 39 prior to the start of the game and place their respective token upon the starting space 12. Because of the complexity of the scoring of the game, it is anticipated that a score sheet 40, as particularly shown in FIG. 4, will be utilized by the players upon which they will maintain their respective scores. It is anticipated that the upper portion of the score sheet shall have certain indicia printed thereon indicating possible scores on particular rolls of the dice, while the lower portion of the sheet will be used to maintain scores of the respective players.

The game board 11, as has been explained, has twenty-three discrete spaces with special instructions that affect the player's turn. The remaining spaces are blank and are counted only as a regular turn with the roll of the dice.

In preparation of play, it would be anticipated that the game board 11 would be placed upon a table of suitable size and the players would take their position around the table and select a playing token 39 of their choice. The playing tokens 39 are then placed on the starting space 12 and the players would designate one particular player as a score keeper. Each player shall then roll one dice to determine the lead player. The highest number rolled would indicate the player who starts the game and the remaining players would then follow in a clockwise manner with each player taking their respective turn with the roll of the dice. At the start of the game if there is a tie for the lead player upon the first roll of the single die, the tied players will then continue to roll until one player is designated the lead player.

The strategy of the game is simply that the play continues until a player has a score of 10,000 points or more, and thereafter each remaining player then has one more turn to attempt to beat the player with the higher score. After all of the players have had one last turn, the highest score wins the game.

The play of the present invention and the rules thereof, is as follows:

The first player rolls two of the dice to determine the number of spaces the player is to move on the board. Once that player's token is advanced to the number of spaces indicated by the roll of the first two dice, the player then starts his turn by rolling all six dice following the scoring rules as indicated on the score sheet 40, and the rules of the space occupied by his playing token 39. The player may continue to roll the dice until he chooses to stop or until he fails to roll a "scoring" die or dice. Any "scoring" die or dice that the player elects to count must be set aside and the player may then continue to roll with the remaining dice.

When all six dice that have been set aside are "scoring" dice, the player must them roll all six dice at one time and continue his turn counting the original six "scoring" dice for his score. If on any roll the player fails to roll a "scoring" die or dice, his/her turn ends and all accumulated score for that turn is lost. The player may elect to end his turn at any time, and all "scoring" die or dice are added to his score. The dice are then passed to the next player. The term "scoring" dice are those die or dice combinations which are shown at the top portion of the score sheet 40. Play then continues until a player has a score of 10,000 points or more. A point of strategy is that if a player nears the score of 10,000 points then that player will consider the score of the other players in relation to his score. The larger lead the player may have, the less chance that another player will beat his/her score in the last turn that the remaining players have after the player in the lead has acquired the 10,000 winning points.

During play, the two wager spaces, 30 and 36, allow other players an opportunity to collect points from the player who lands on the wager space. If the player who lands on the wager space chooses, that player may offer the other players the opportunity to wager a portion of their score on the chance that points that the first player will score at least 300 points on his/her initial roll of all six dice. If that player does roll at least 300 points, all players who choose to wager deduct 1,000 points from their score and the first player adds these points to his/her score in addition to the points he/she scored on his/her turn. If the first player fails to score 300 points on his/her initial roll, he/she awards 500 points of his/her score to each player who chooses to wager and he/she then completes his/her turn.

Various modifications may be made of the invention without departing from the scope thereof. It is desired, therefore, that only such limitations shall be placed thereon as are imposed by the prior art and which are set forth in the appended claims.

What is claimed is:

1. A board game combining skill and chance comprising, a playing board, said playing board having at least forty discreet playing locations juxtaposed one after the other around the perimeter of the board, twenty-three of the playing locations having playing instructions printed thereon, a plurality of playing tokens for movement around the board by respective players, six playing dice for indicating score for the player upon rolling of the dice wherein at least two of said dice being utilized for indicating movement of the playing tokens of each player around the board playing space, the dice further controlling movement of the playing tokens around the board, each die of the playing dice having all its faces marked with symbols of different numerical value, whereby each face of a die bears a numerical symbol of different value from the numerical symbols on the other faces of the die, the playing tokens of each player being caused to be moved on the board the number of locations corresponding to the sum of the numerical values on at least two rolled dice;

a scoring card having indicia comprising a plurality of discrete scoring combinations corresponding to predetermined combinations of said rolled playing dice, wherein when said predetermined combinations on said rolled playing dice match the discrete scoring combinations on the scoring card the player achieves a predetermined point score, wherein the game is played until one player reaches a predetermined score greater than the scores of the remaining players.

2. The board game as claimed in claim 1, wherein upon the roll of the dice and one of the dice indicates a value of one corresponding to the predetermined combination shown on the scoring card, the player is awarded one hundred points.

3. The board game as claimed in claim 1, wherein upon the roll of the dice and one of the dice indicates a value of five corresponding to the predetermined combination shown on the scoring card, the player is awarded fifty points.

4. The board game as claimed in claim 1, wherein upon the roll of the dice and the six dice indicate a numerical ascending value of one through six corresponding to the predetermined combination shown on the scoring card, the player is awarded one thousand five hundred points.

5. The board game as claimed in claim 1, wherein upon the roll of the dice and the dice show three pair with each respective pair having the same numerical value and which value differs from the other two pairs corresponding to the predetermined combination shown on the scoring card, the player is awarded one thousand points.

6. The board game as claimed in claim 1, wherein upon the roll of the dice and any three of the dice indicate the numerical value of one corresponding to the predetermined combination shown on the scoring card, the player is awarded one thousand points.

7. The board game as claimed in claim 1, wherein upon the roll of the dice and any four of the dice indicate the numerical value of one corresponding to the predetermined combination shown on the scoring card, the player is awarded two thousand points.

8. The board game as claimed in claim 1, wherein upon the roll of the dice and any five of the dice indicate the numerical value of one corresponding to the predetermined combination shown on the scoring card, the player is awarded three thousand points.

9. The board game as claimed in claim 1, wherein upon the roll of the dice and any three of the dice indicate the same numerical value corresponding to the predetermined combination shown on the scoring card, the player is awarded points totalling one hundred times the face numerical value of one of said three dice.

10. The board game as claimed in claim 1, wherein upon the roll of the dice and any four of the dice indicate the same numerical value corresponding to the predetermined combination shown on the scoring card, the player is awarded points totalling two hundred times the face numerical value of one of said four dice.

11. The board game as claimed in claim 1, wherein upon the roll of the dice and any five of the dice indicate the same numerical value corresponding to the predetermined combination shown on the scoring card, the player is awarded points totalling three hundred times the face numerical value of one of said five dice.

12. The board game as claimed in claim 1, wherein upon the roll of the dice and any six of the dice indicate the same numerical value corresponding to the predetermined combination shown on the scoring card, the player is awarded points totalling four hundred times the face numerical value of one of said six dice.

13. The board game as claimed in claim 1, wherein upon the roll of the dice and all six of the dice indicate the numerical value of one corresponding to the predetermined combination shown on the scoring card, the player is awarded an automatic win.

* * * * *